US007983608B2

(12) United States Patent
Sugiyama

(10) Patent No.: US 7,983,608 B2
(45) Date of Patent: Jul. 19, 2011

(54) CLEANING APPARATUS

(75) Inventor: Shin-ichi Sugiyama, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 12/556,513

(22) Filed: Sep. 9, 2009

(65) Prior Publication Data

US 2010/0061780 A1 Mar. 11, 2010

(30) Foreign Application Priority Data

Sep. 11, 2008 (JP) ..... 2008-233166

(51) Int. Cl.

| | |
|---|---|
| ***G03G 21/10*** | (2006.01) |
| ***G03G 21/00*** | (2006.01) |
| ***G03G 21/16*** | (2006.01) |
| ***G03G 15/16*** | (2006.01) |

(52) U.S. Cl. ..... 399/351; 399/110; 399/123; 399/343; 399/350

(58) Field of Classification Search ..... 399/98, 399/99, 101, 107, 110, 123, 343, 345, 350, 399/351, 358, 359

See application file for complete search history.

(56) References Cited

U.S. PATENT DOCUMENTS 6,137,973 A * 10/2000 Nishiuwatoko et al. ..... 399/111
2005/0196205 A1* 9/2005 Osawa ..... 399/345
2007/0230990 A1* 10/2007 Ogasawara et al. ..... 399/101
2007/0286653 A1* 12/2007 Watanabe et al. ..... 399/350

FOREIGN PATENT DOCUMENTS

| | | |
|---|---|---|
| JP | 09-152823 | 6/1997 |
| JP | 2003-122228 | 4/2003 |
| JP | 2004-109799 | 4/2004 |

* cited by examiner

*Primary Examiner* — David P Porta
*Assistant Examiner* — Jessica L Eley
(74) *Attorney, Agent, or Firm* — Canon USA Inc IP Division

(57) ABSTRACT

A cleaning apparatus for cleaning toner on an image bearing member includes a cleaning blade for collecting the toner by contacting an edge portion thereof with the image bearing member, a container for storing the toner, a first rotation axis for rotatably supporting the cleaning blade, an urging member for urging the cleaning blade, a positioning portion for positioning the cleaning blade so that the cleaning blade urged by the urging member stands by at a predetermined position when the cleaning blade is not in contact with the image bearing member, and a second rotation axis for rotatably supporting the cleaning apparatus while contacting a part of a main body when the cleaning apparatus is mounted on the main body, wherein the edge portion is positioned on a straight line or away from the image bearing member with respect to the straight line connecting rotation centers of the first rotation axis and of the second rotation axis when the cleaning blade is located at the predetermined position.

4 Claims, 14 Drawing Sheets

CLEANING APPARATUS

BACKGROUND OF THE INVENTION

1. Field of the Invention

The present invention relates to a cleaning apparatus used in an image forming apparatus such as a copying machine and a printer which use an electrophotographic process or an electrostatic recording process.

2. Description of the Related Art

A cleaning blade provided in the cleaning apparatus for cleaning an image bearing member such as a photosensitive drum and an intermediate transfer member is regarded as a consumable and replaced with a new one when it reaches its life time. The cleaning blade is generally replaced after the cleaning apparatus detachably mounted on a main body of the image forming apparatus has been removed from the main body thereof. When the cleaning apparatus is removed from the main body of the image forming apparatus, however, toner is liable to fall from an opening of the cleaning apparatus to dirty the inside of the image forming apparatus, and may adversely affect a product. Mounting and demounting the cleaning apparatus may damage the cleaning blade and the image bearing member.

In view of the above problem, there has been discusses a configuration illustrated in FIG. 12. FIG. 12 illustrates a toner collection tray 102 which accumulates toner falling from a space between a cleaner unit 100 and an intermediate transfer belt 101 and stores it therein. The toner collection tray 102 is provided substantially under the space between the cleaner unit 100 and the intermediate transfer belt 101 to prevent the falling toner from dirtying the inside of the image forming apparatus (refer to Japanese Patent Application Laid-Open No. 2004-109799).

A detachable cleaning apparatus 70 has been discussed as illustrated in FIG. 13. When a position regulation plate 71 is set in a release position, a rotation lever 72 and a pressing plate spring 73 are brought into a free state. Accordingly, a support shaft 76 guides the cleaning apparatus with an opening 75 of a casing 74 oriented substantially upward, and the cleaning apparatus can be mounted and demounted. This configuration can prevent the toner from falling down (refer to Japanese Patent Application Laid-Open No. 09-152823).

A detachable cleaning apparatus 80 has also been discussed, as illustrated in FIG. 14. A cleaning blade 81 is rotatable around a rotating shaft 82 in an image forming apparatus capable of preventing a cleaning unit and an image bearing member from being scratched or the image bearing member from loosening during mounting and demounting the cleaning unit. The cleaning blade 81 is separated from an intermediate transfer belt 85 by a separate arm 84 which moves along with a rotation axis 83 in attaching and detaching the cleaning blade 81. This configuration allows preventing the cleaning blade and the intermediate transfer belt from being scratched or unnecessarily bending when the cleaning blade is attached and detached (refer to Japanese Patent Application Laid-Open No. 2003-122228).

In the configuration described in Japanese Patent Application Laid-Open No. 2004-109799, however, a specific collection tray needs to be provided and a space for the tray also needs to be secured.

In the configuration described in Japanese Patent Application Laid-Open No. 09-152823, the cleaning apparatus can be mounted and demounted with the opening 75 of the cleaning apparatus oriented substantially upward, so that the toner will not spill from the opening during an mounting and demounting operation. However, if the blade is brought into contact with a member to be cleaned in the case where a rotation fulcrum 76 is arranged in a position in FIG. 12, the following problem may occur. Reaction force is generated in a direction to compress the blade in a free length direction by further pressing the blade after the blade has been brought into contact with the member, so that a leading edge of the blade and the member to be cleaned may be rubbed together to be damaged or the blade may be bent.

In the configuration described in Japanese Patent Application Laid-Open No. 2003-122228, there is provided a retreating mechanism in which the cleaning blade is separated from the intermediate transfer belt in attaching and detaching the cleaning blade, however, the apparatus is complicated in configuration and has a drawback from the viewpoint of space and cost.

SUMMARY OF THE INVENTION

The present invention is directed to prevent unnecessary force from being applied to a cleaning blade when the cleaning blade is in contact with a member to be cleaned.

According to an aspect of the present invention, a cleaning apparatus which cleans toner on an image bearing member includes a cleaning blade configured to collect toner on a surface of the image bearing member by contacting an edge portion thereof with the image bearing member, a container configured to store the collected toner therein, a first rotation axis configured to rotatably support the cleaning blade, an urging member configured to urge the cleaning blade, a positioning portion configured to position the cleaning blade so that the cleaning blade urged by the urging member stands by at a predetermined position when the cleaning blade is not in contact with the image bearing member, and a second rotation axis configured to rotatably support the cleaning apparatus while contacting a part of a main body when the cleaning apparatus is mounted on the main body, wherein the edge portion is positioned on a straight line or away from the image bearing member with respect to the straight line connecting a rotation center of the first rotation axis with a rotation center of the second rotation axis when the cleaning blade is located at the predetermined position.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Figure 1:
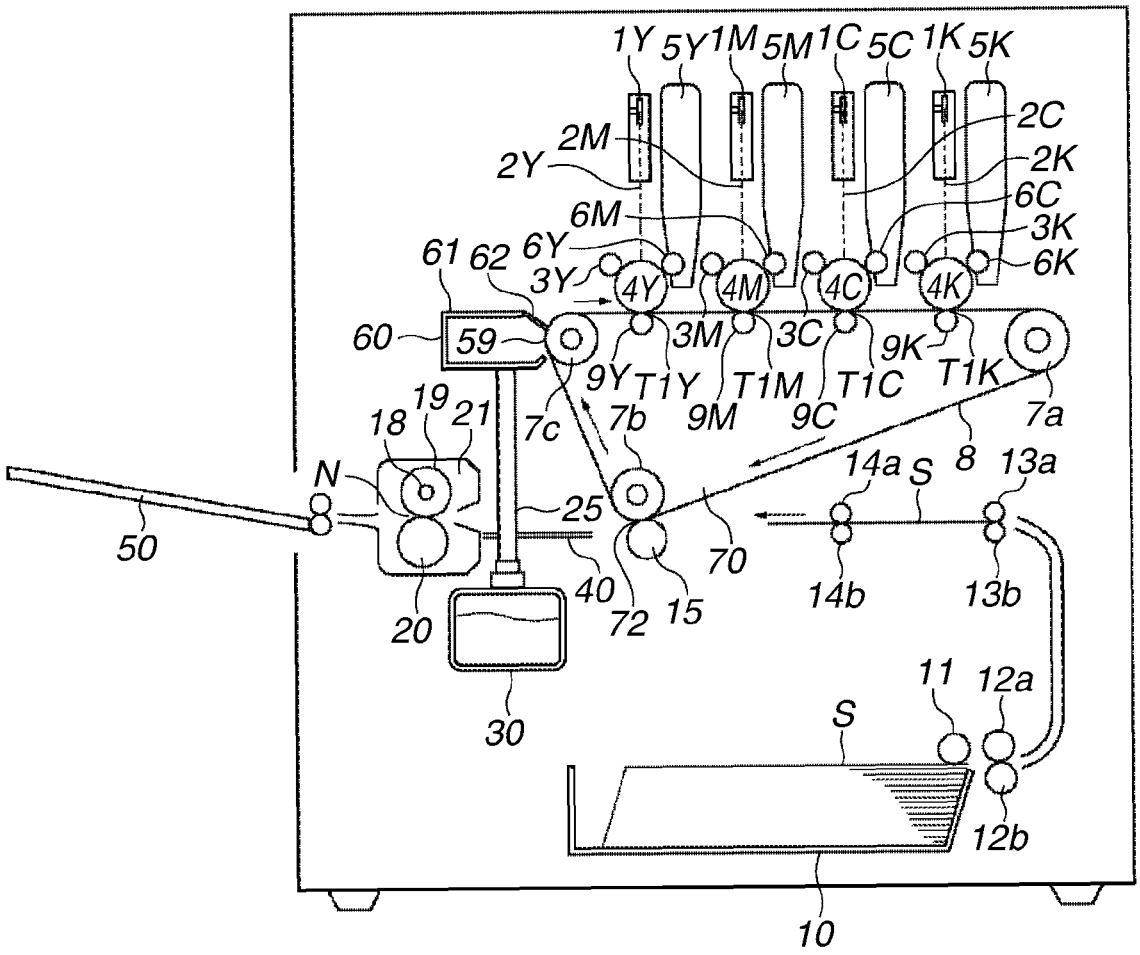
FIG. 1 is a cross section illustrating an entire image forming apparatus in an exemplary embodiment of the present invention.

Various exemplary embodiments, features, and aspects of the invention will be described in detail below with reference to the drawings.

Exemplary embodiments of the present invention are described in detail with reference to the drawings. The dimensions, materials, and shapes of the components described below and a relative arrangement therebetween may be changed according to the configuration of an apparatus to which the present invention is applied and various conditions. Unless otherwise specified, the scope of the present invention is not limited only to those.

An image forming apparatus according to a first exemplary embodiment of the present invention is described below with reference to FIG. 1.

Surfaces of photosensitive drums (image bearing members) 4Y, 4M, 4C, and 4K for respective colors are uniformly charged by charging rollers 3Y, 3M, 3C, and 3K. Thereafter, laser beams 2Y, 2M, 2C and 2K are emitted according to image data for each color from laser scanner units 1Y, 1M, 1C and 1K corresponding to respective colors of yellow, magenta, cyan, and black. The photosensitive drums 4Y, 4M, 4C, and 4K for respective colors are irradiated with the beams to form electrostatic images.

The electrostatic images are developed by toners for respective colors included in development devices 5Y, 5M, 5C and 5K corresponding to the respective colors via development sleeves 6Y, 6M, 6C, and 6K for respective colors. The developed toner images for respective colors are primarily transferred sequentially to an intermediate transfer belt (an image bearing member) 8 which is rotated clockwise (in a direction indicated by an arrow in the figure) by belt drive rollers 7*a*, 7*b*, and 7*c*.

The primary transfer is performed by primary transfer rollers 9Y, 9M, 9C, and 9K urging the belt against the drums from the inside at primary transfer points T1Y, T1M, T1C, and T1K. Accordingly, the toner image on which four color images are superimposed is formed on the intermediate transfer belt 8.

A transfer material S fed from a feeding cassette 10 by a feeding roller 11 is conveyed by a conveyance roller pair 12*a* and 12*b* and a conveyance roller pair 13*a* and 13*b*. Then, the transfer material S is further conveyed to a secondary transfer point T2 by a registration roller pair 14*a* and 14*b* in synchronization with the above toner image.

At the secondary transfer point T2, the intermediate transfer belt and the transfer material are held between a secondary transfer roller 15 and the belt drive roller 7*b* to be conveyed. A high-voltage transfer bias is applied to the secondary transfer roller to collectively transfer (secondarily transfer) the toner image on the intermediate transfer belt 8 onto the transfer material.

The toner which is not transferred and remained on a surface of the image bearing member is scraped by a cleaning blade (a cleaning member) 62 made of a rubber piece arranged to be brought into contact with the intermediate transfer belt 8. The scraped toner is collected into a cleaner container 61. The toner collected into the cleaner container 61 is caused to pass though a pipe 25 by a screw to be stored in a waste toner bottle 30 detachably disposed on the end of the pipe 25. The waste toner bottle 30 is replaced with an empty bottle by a user or a service people when it is filled.

The transfer material S on which an image is formed by the secondary transfer passes on a conveyance guide 40 and then is conveyed to a fixing apparatus 21. The fixing apparatus 21 includes a fixing roller 19 including a halogen heater 18 and a pressure roller 20 which rotates while contacting the fixing roller 19 at a predetermined pressure. These rollers form a nip N.

The transfer material S passes through the nip N to be fixed the transferred toner image thereon by heat and pressure and is discharged onto a discharge tray 50.

In the present exemplary embodiment, the cleaning apparatus is detachable from a main body which is provided with the image bearing member. The present exemplary embodiment has a configuration in which toner will not spill from an opening of the cleaning apparatus at the time of removing the cleaning apparatus from an intermediate transfer belt unit (the main body). Further in the configuration of the present exemplary embodiment, a leading edge of the cleaning blade or a surface to be cleaned can be prevented from being damaged by unnecessary reaction force acting on the cleaning blade at the time of mounting the cleaning apparatus. The present exemplary embodiment is described in detail below.

In FIG. 1, a cleaner unit 60 as the cleaning apparatus is in contact with a surface of the intermediate transfer belt (an intermediate transfer member) 8 as an image bearing member at a part facing the belt drive roller 7*c*.

Figure 2:
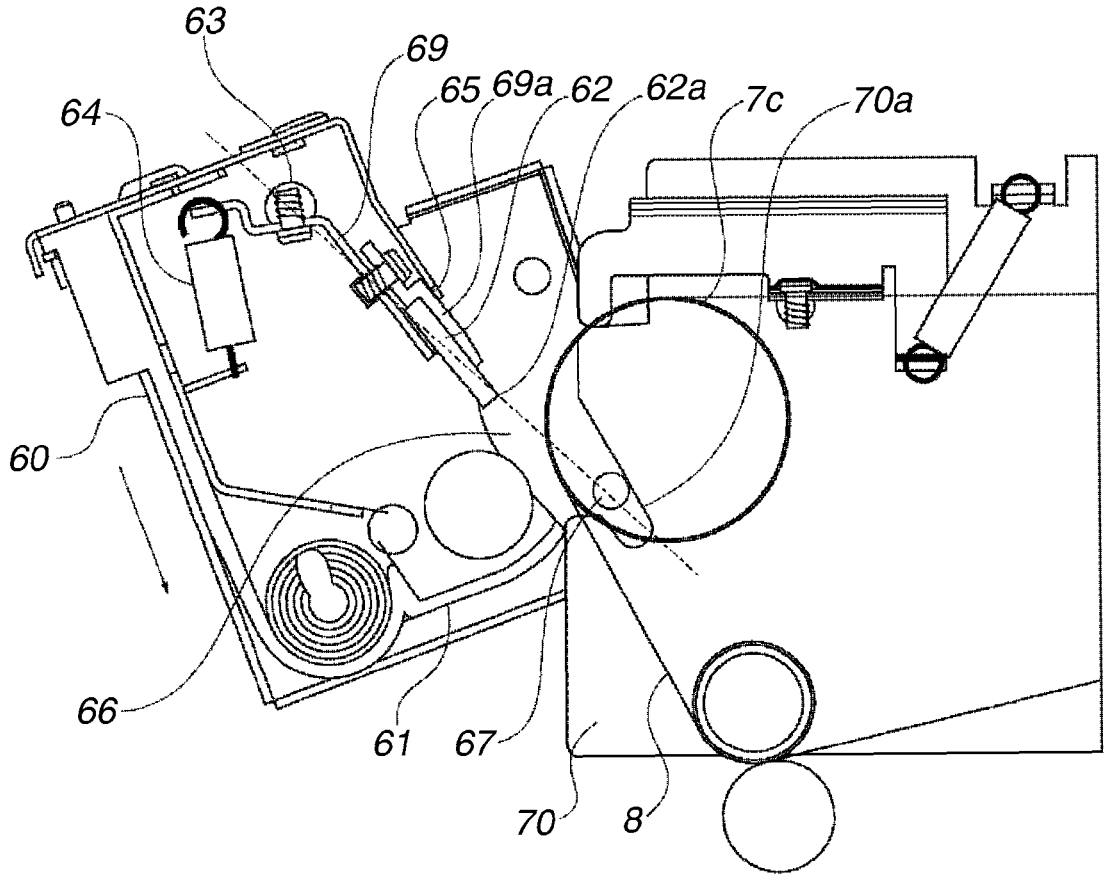
FIG. 2 is a cross section illustrating a procedure for mounting a cleaner unit.

FIG. 2 illustrates that the cleaner unit 60 is being mounted on the main body. In this state, the cleaning blade 62 is not in contact with the image bearing member.

In FIG. 2, the cleaning blade 62 is made of urethane rubber, for example, and sandwiched and held between a first supporting member 69 and a second supporting member 69*a*. A cleaning member is formed of the cleaning blade 62 and the supporting members 69 and 69*a*.

The first supporting member 69 supporting the cleaning blade is rotatably provided on the cleaner unit 60 with a first rotation axis 63 as a center. A pressure spring 64 being an urging member is attached to one end of the first supporting member 69. The first supporting member 69 is subjected to a force rotating counterclockwise around the first rotation axis 63 by the pressure spring 64.

A leading edge 62*a* of the cleaning blade is subjected to a force toward the intermediate transfer belt 8 by the action of the pressure spring 64. If the cleaning blade is not in contact with the image bearing member, a part of the cleaning member (i.e., the second supporting member 69*a*) rotated by the force of the pressure spring 64 is brought into contact with an abutting portion 65 provided on the cleaner container 61.

Accordingly, the cleaning member is positioned at a predetermined position. The predetermined position thus regulated is referred to as a standby position. The abutting portion 65 serves as a positioning portion.

The cleaning blade 62 in which a rubber piece typified by urethane rubber is securely provided on a metallic plate spring in general has a length exceeding a maximum sheet-passing width (a length in the depth direction in the figure) as is the case with the intermediate transfer belt 8.

The cleaning blade 62 has a function to scrape residual toner, collect and store it in the cleaner container 61 by urging the leading edge 62*a* of the cleaning blade against the surface of the intermediate transfer belt 8 at a constant pressure by force of the pressure spring 64 and elastic force of the rubber.

The edge portion of the cleaning blade 62 wears down while being used and lowers in cleaning performance, so that the cleaning blade 62 needs to be replaced by a user or a service people on several occasions during the service life of the main body of the apparatus. In this case, the cleaner unit 60 is removed from the main body and then the cleaning blade is replaced.

Such a configuration has a problem in that toner falls or scatters from an opening 66 of the cleaner unit 60 when the cleaner unit 60 is separated from the intermediate transfer belt 8.

As illustrated in FIG. 2, the present exemplary embodiment has a configuration in which the opening 66 of the cleaner unit is oriented upward to prevent toner from falling in separating the cleaner unit from the intermediate transfer belt.

A second rotation axis 67 provided below the opening 66 of the cleaner unit 60 is guided to a guide groove 70*a* (a guiding unit) formed in an intermediate transfer member unit 70 including the intermediate transfer belt 8. The cleaner unit 60 is guided to a predetermined position with the opening 66 oriented upward. The second rotation axis 67 is rotatably supported while contacting the bottom (a part of the main body) of the guide groove 70*a*. The cleaner unit 60 is rotated to and fixed at a cleaning position where the cleaner unit 60 performs cleaning.

Amounting operation is described in detail below with reference to FIGS. 2 to 7.

As illustrated in FIG. 2, the second rotation axis 67 is put in the guide groove 70*a* (a guiding unit) formed in the intermediate transfer member unit 70 with the cleaner unit 60 tilted so that the opening 66 of the cleaner unit 60 is oriented upward. The cleaner unit 60 is caused to fall in the gravity direction and in the direction indicated by an arrow in the figure along the guide groove 70*a*.

The second rotation axis 67 of the cleaner unit 60 contacts the downmost point of the guide groove 70*a* and is rotatably fitted. At this point, the second supporting member 69*a* is in contact with the abutting portion 65 provided on the cleaner container 61 to regulate the motion of the cleaning blade 62 urged in the direction of the belt drive roller 7*c* with the first rotation axis 63 as a rotation center.

Figure 3:
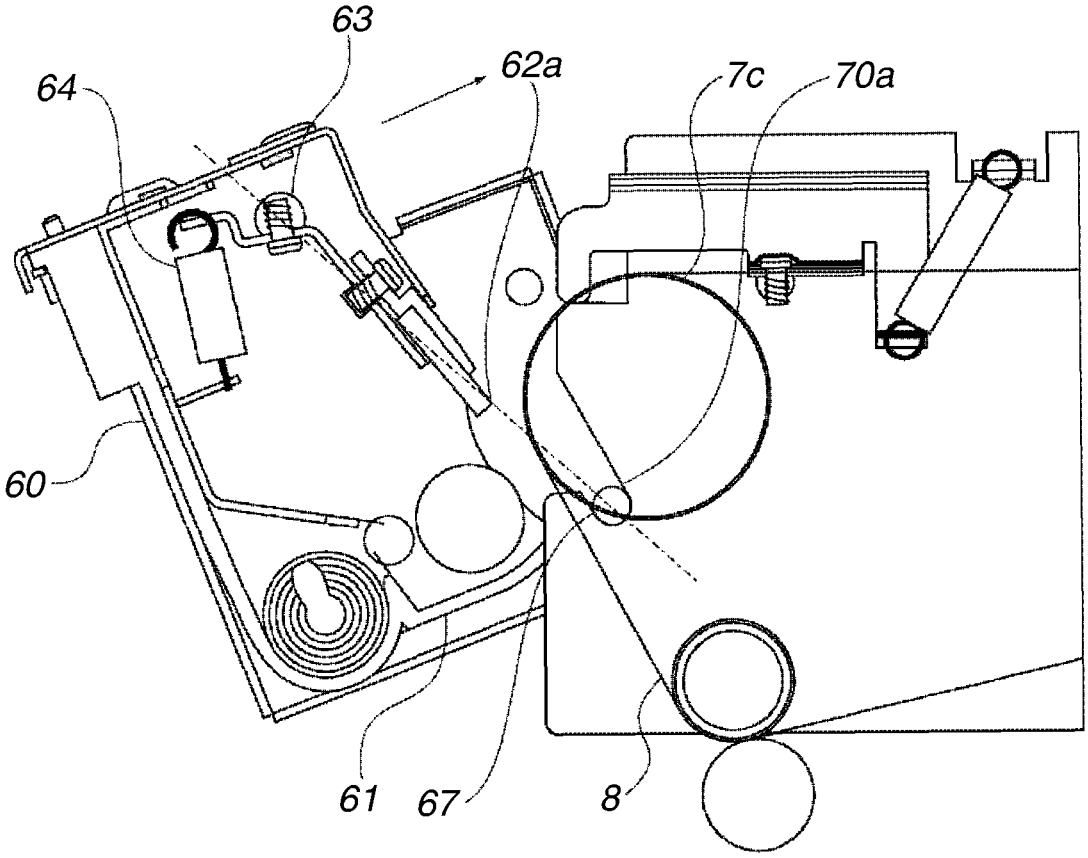
FIG. 3 is a cross section illustrating a procedure for mounting the cleaner unit.

As illustrated in FIG. 3, the cleaner unit 60 pivotally supported at the downmost point of the guide groove 70*a* is rotated in the direction indicated by an arrow in the figure (clockwise). The leading edge 62*a* of the cleaning blade approaches the belt drive roller 7*c* along a locus with the second rotation axis 67 as a rotation center.

Figure 4:
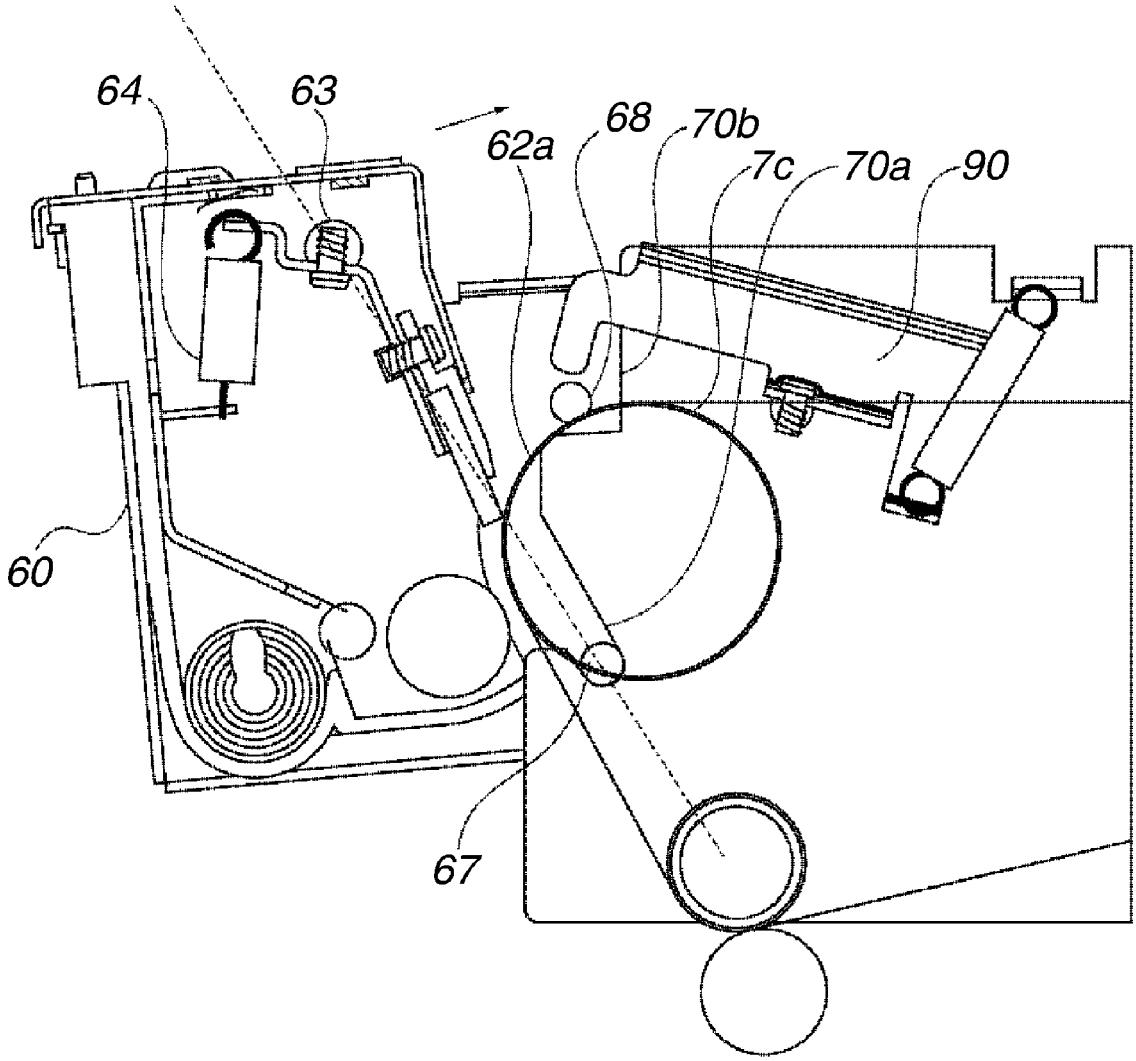
FIG. 4 is a cross section illustrating a procedure for mounting the cleaner unit.

FIG. 4 illustrates a moment the leading edge 62*a* of the cleaning blade contacts the surface of the intermediate transfer belt 8 on the belt drive roller 7*c*. The leading edge 62*a* of the cleaning blade needs to be urged against the surface of the intermediate transfer belt 8 at a constant pressure to obtain the function of cleaning. For that purpose, the cleaner unit 60 is further rotated in the direction indicated by an arrow in the figure (clockwise).

Figure 5:
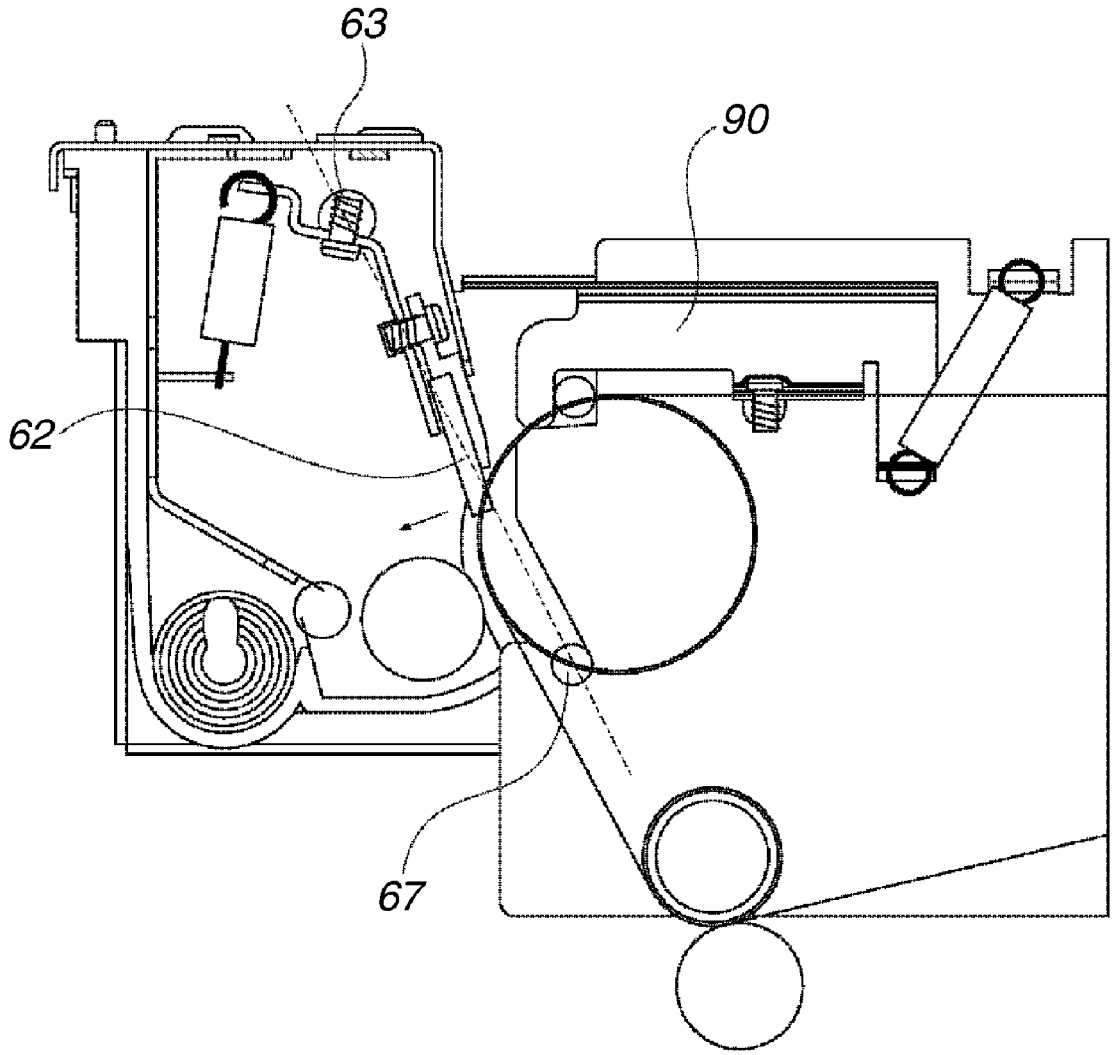
FIG. 5 is a cross section illustrating a procedure for mounting the cleaner unit.

The cleaner unit 60 is rotated until a stationary axis (a stationary unit) 68 which is securely provided on the cleaner unit 60 contacts a stationary-axis abutting portion 70*b* provided on the intermediate transfer member unit 70 (on the side of the main body) to hold the cleaner unit 60 at the cleaning position. As illustrated in FIG. 5, the stationary axis 68 is engaged with a latch (an engaging unit) 90 which is pivotally supported with the intermediate transfer member unit 70 and fixed.

Figure 6:
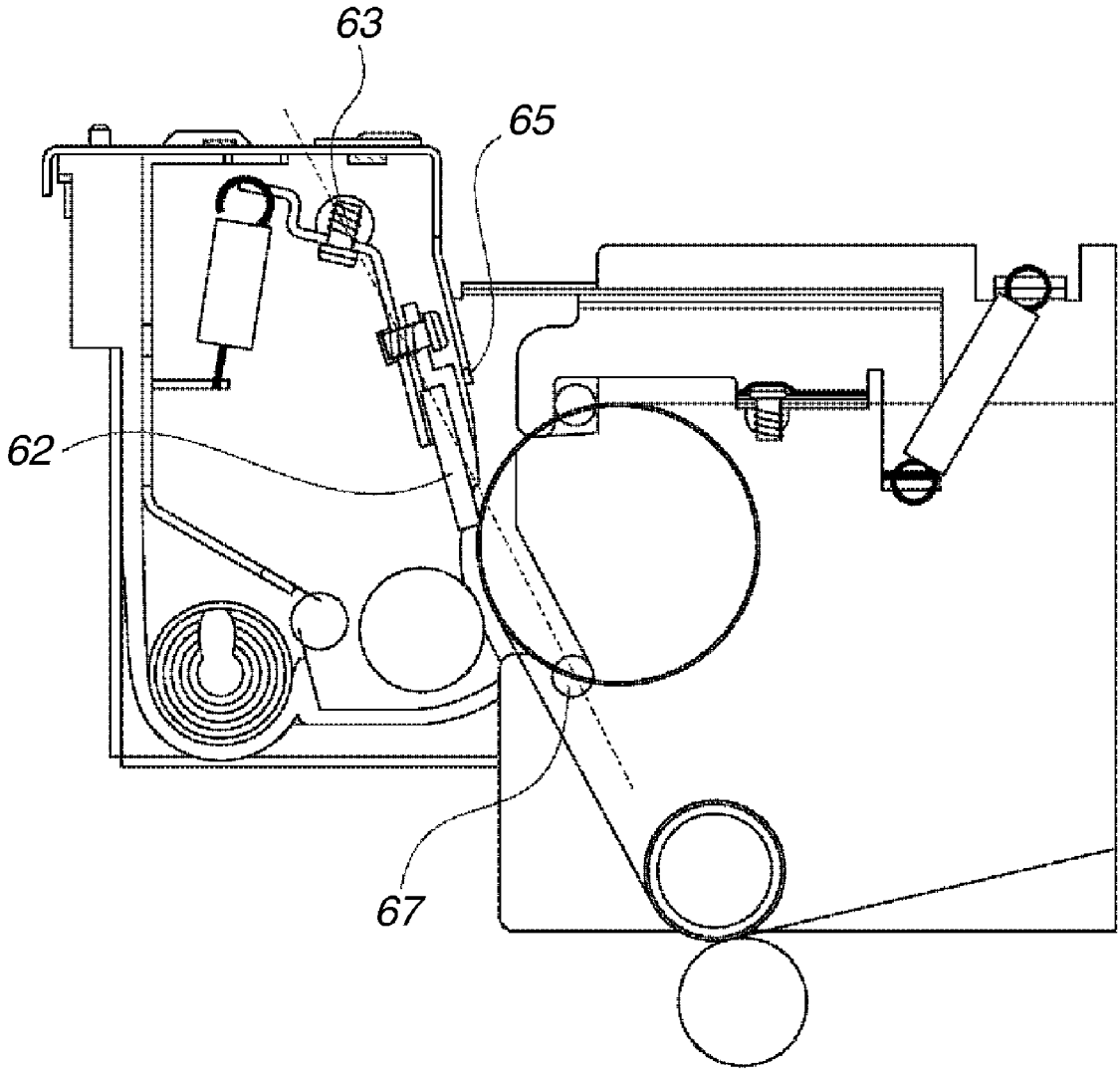
FIG. 6 is a cross section illustrating a procedure for mounting the cleaner unit.
Figure 7:
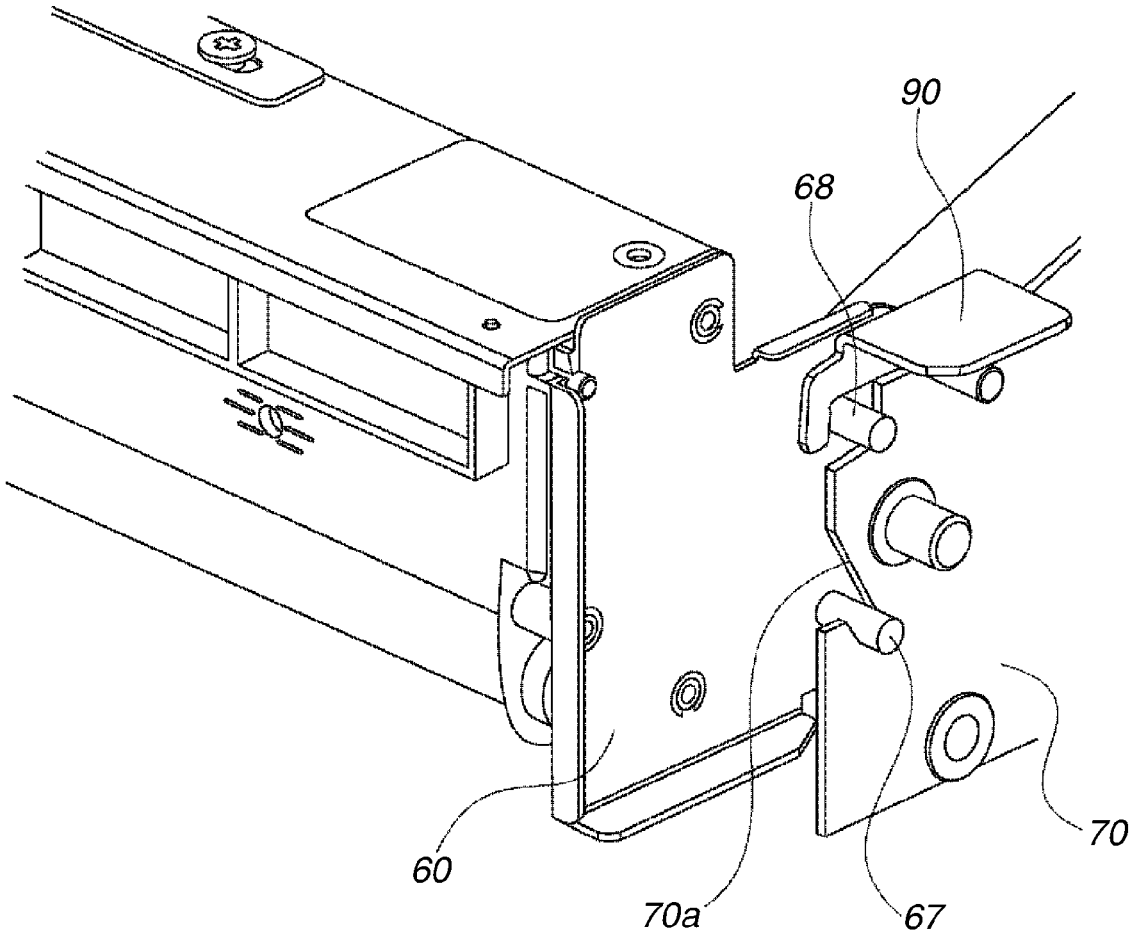
FIG. 7 is a perspective view illustrating principal parts of the mounted cleaner unit.

Referring to FIGS. 5 and 6, there are described processes in which the leading edge 62*a* of the cleaning blade illustrated in FIG. 4 contacts the surface of the intermediate transfer belt 8 and the cleaner unit 60 is held at the cleaning position at the time of forming an image.

When the cleaner unit 60 is rotated from the position in FIG. 4 to that in FIG. 5, the leading edge 62*a* of the cleaning blade is subjected to reaction force from the intermediate transfer belt 8 and pushed back against the spring force of the pressure spring 64 and the elastic force of the rubber piece in the direction indicated by the arrow in FIG. 5 with the first rotation axis 63 as a center. As illustrated in FIG. 6, the second supporting member 69*a* is away from the abutting portion 65 and the cleaner unit 60 is held at a position where a desired blade pressure is applied to the surface of the intermediate transfer belt 8.

In the state of FIG. 2 where the cleaning blade 62 is not in contact with the intermediate transfer member and the abutting portion 65 regulates the position of the cleaning blade 62, the present invention is characterized by the position of the leading edge 62*a* of the cleaning blade. More specifically, the leading edge 62*a* is positioned on a straight line connecting the rotation center of the first rotation axis 63 to the rotation center of the second rotation axis 67 or on a side away from the image bearing member with respect to the straight line.

Figure 8:
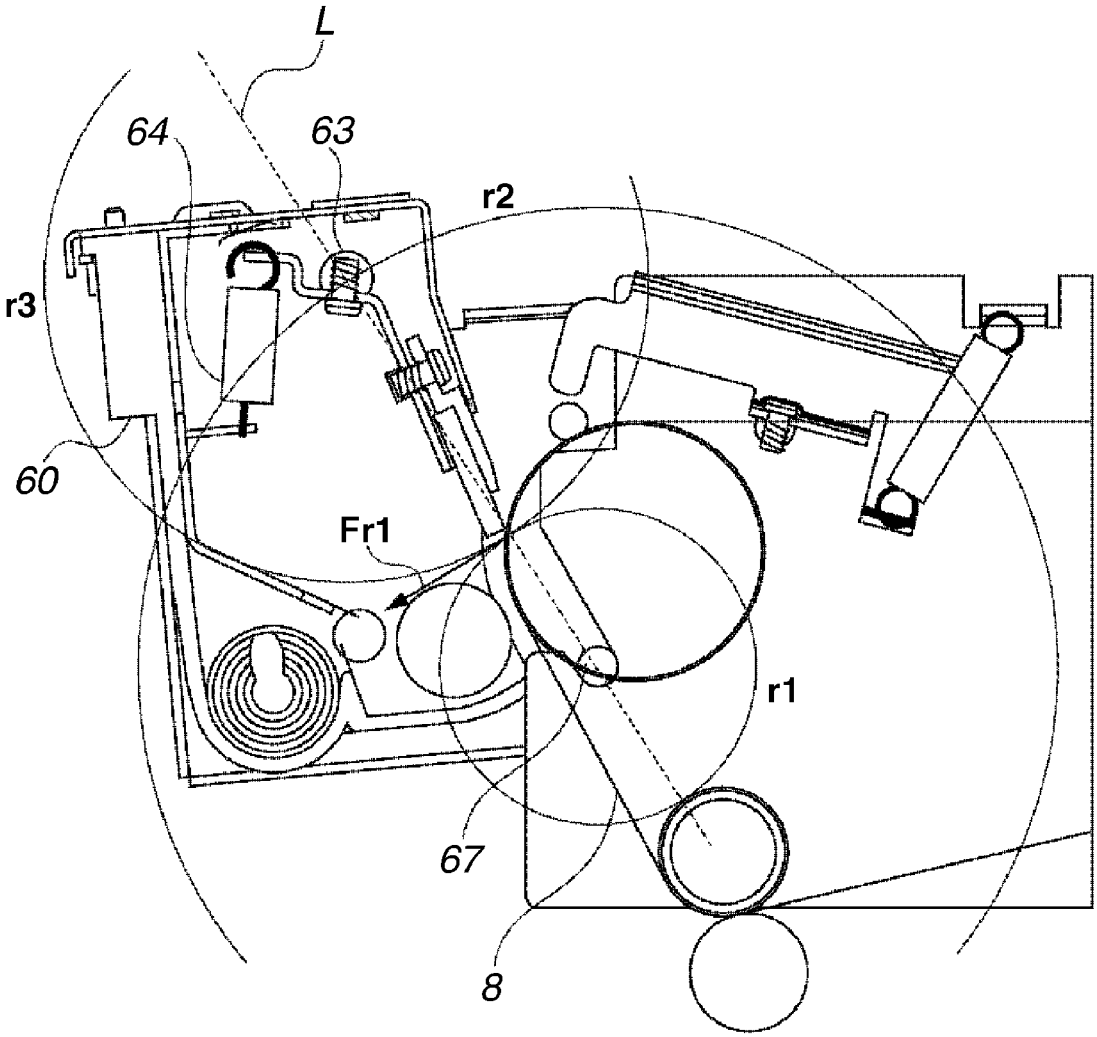
FIG. 8 illustrates reaction force applied to a blade in the exemplary embodiment of the present invention.
Figure 9:
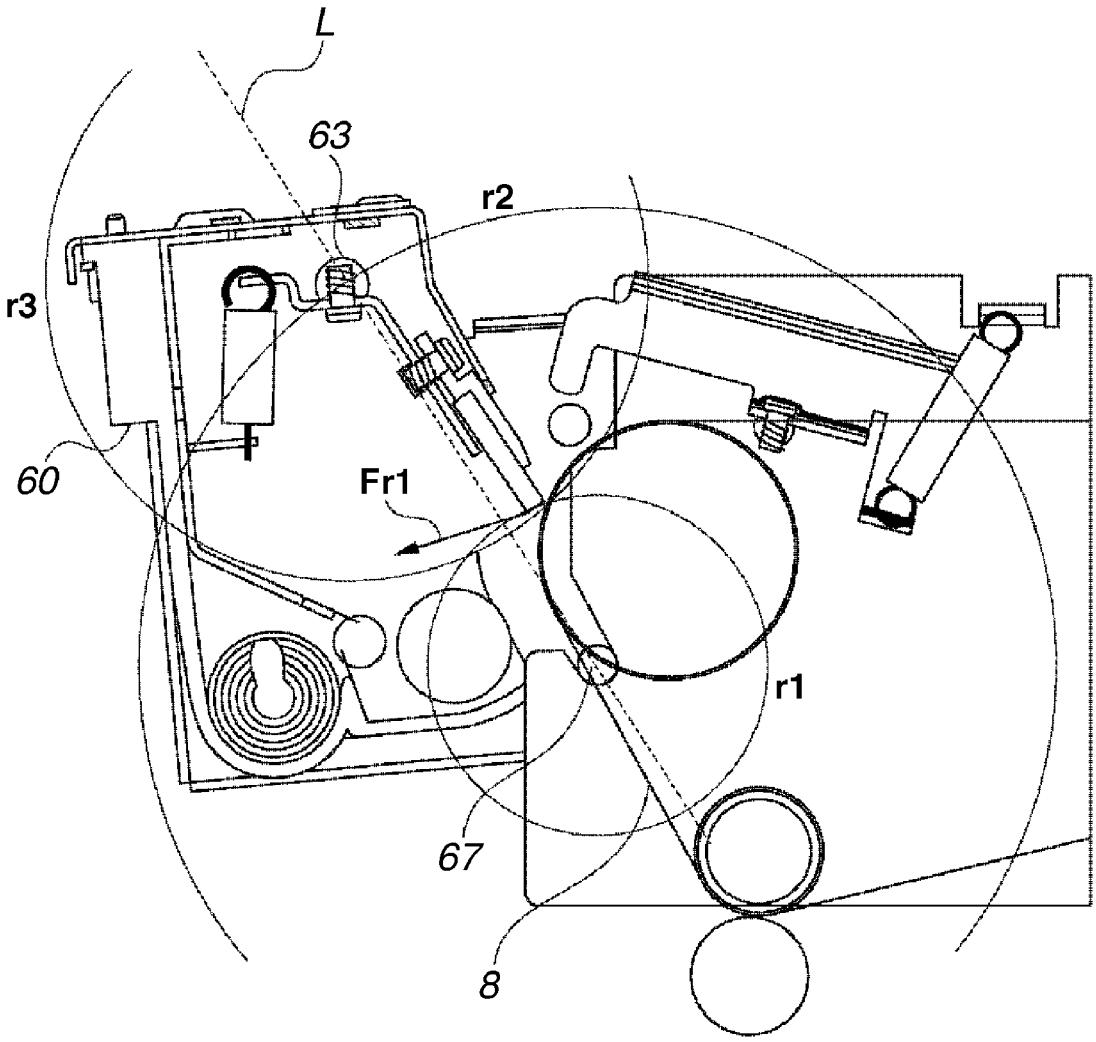
FIG. 9 illustrates reaction force applied to the blade in a comparison example.
Figure 10:
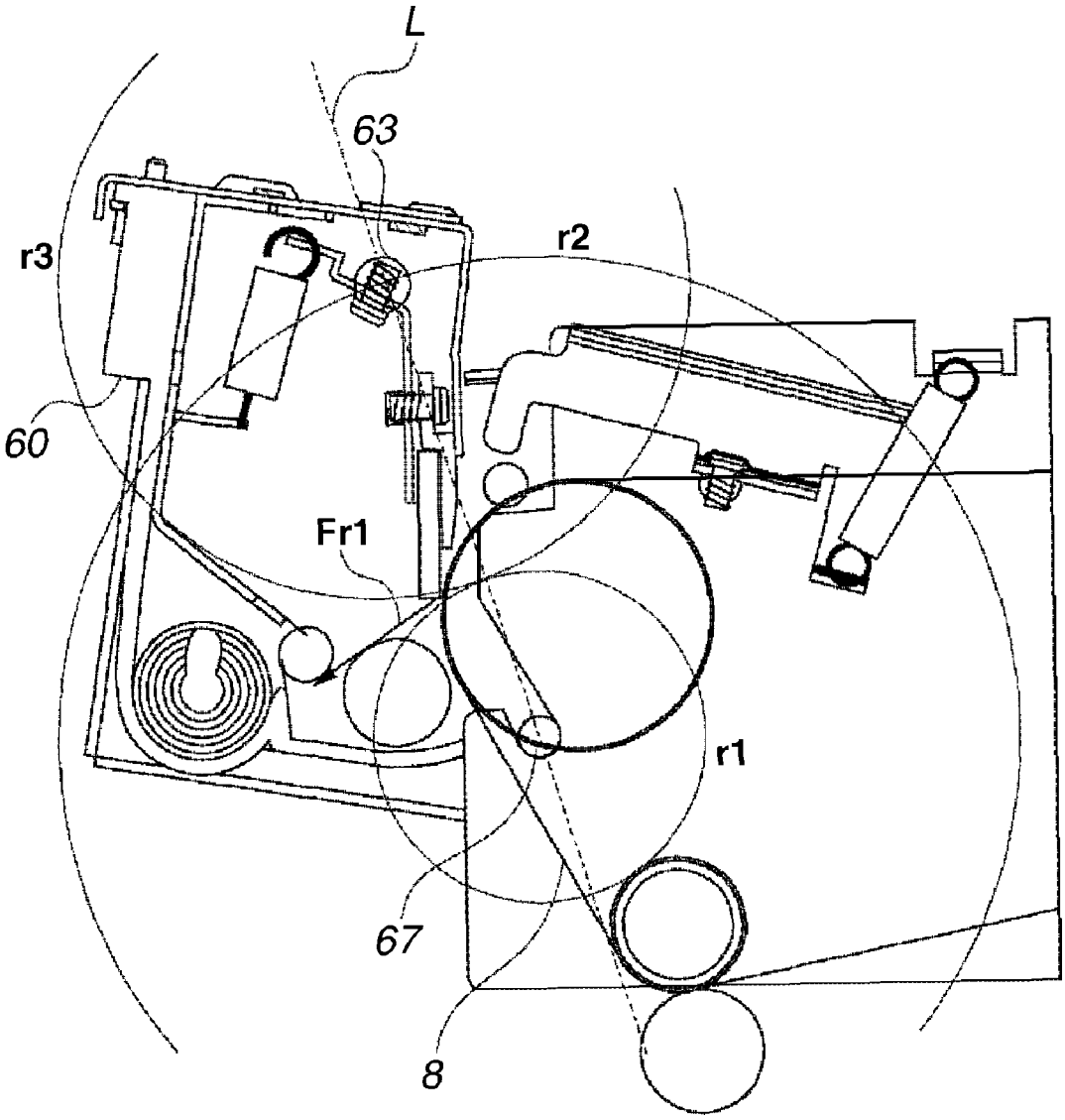
FIG. 10 illustrates reaction force applied to the blade in the exemplary embodiment of the present invention.

FIGS. 8, 9, and 10 are cross sections illustrating the direction in which pressure is applied to the leading edge of the cleaning blade in mounting the cleaner unit 60.

FIG. 8 is similar to FIG. 4 and illustrates loci drawn when the leading edge 62*a* of the cleaning blade is in contact with the intermediate transfer belt 8 at the standby position and pushed back by reaction force. In the configuration of FIG. 8, the leading edge 62*a* is positioned on a straight line L at the standby position.

In FIG. 8, the leading edge 62*a* moves on a circular arc r1 centered about the second rotation axis 67 before the leading edge 62*a* is in contact with the intermediate transfer belt 8 at the standby position. When the cleaner unit 60 is rotated, the first rotation axis 63 which is the rotation center of the cleaning blade 62 moves on a circular arc r2 before and after the leading edge 62*a* is in contact with the intermediate transfer belt 8. When the cleaner unit 60 is further rotated after the leading edge 62*a* is in contact with the intermediate transfer belt 8, the leading edge 62*a* moves on a circular arc r3 centered about the first rotation axis 63.

In this condition, when the leading edge 62*a* is in contact with the intermediate transfer belt 8 at the time of mounting the cleaner unit, the leading edge 62*a* is subjected to reaction force Fr1 from the surface of the intermediate transfer belt. The direction of the reaction force Fr1 as illustrated in FIG. 8 is tangential to the position where the cleaning blade is in contact with the intermediate transfer belt on the locus r1. Since the leading edge 62*a* of the cleaning blade is positioned on the straight line L, the direction of the reaction force Fr1 is also tangential to the locus r3. Therefore, in such a positional relationship, the reaction force Fr1 does not generate force in a direction in which the blade is compressed in a free length direction (in a radial direction toward the center of the locus r3), so that unnecessary force is not applied to the blade. Accordingly, the configuration in FIG. 8 can prevent the leading edge of the cleaning blade and the member to be cleaned from being rubbed together to be damaged or the blade from being bent.

FIG. 10 illustrates a configuration in which the standby position of the leading edge 62*a* of the cleaning blade is located (inside the container) away from the image bearing member with respect to the straight line L. Even in the configuration of FIG. 10, the direction of the reaction force Fr1 is tangential to the position where the cleaning blade is in contact with the intermediate transfer belt on the locus r1. Further, the direction of the reaction force Fr1 is away from the locus r3, that is, opposite to the direction in which the blade is compressed in the free length direction.

In the configuration of FIG. 10, a force is not generated in the direction in which the blade is compressed in the free length direction, so that unnecessary force is not applied to the blade. Therefore, the configuration of FIG. 10 can also prevent the leading edge of the cleaning blade and the member to be cleaned from being rubbed together to be damaged or the blade from being wound.

FIG. 9 illustrates a configuration of a comparative example of the exemplary embodiment of the present invention. In FIG. 9, the standby position of the leading edge 62*a* of the cleaning blade is located (outside the container) near the image bearing member with respect to the straight line L. Even in the configuration of FIG. 9, the direction of the reaction force Fr1 is tangential to the position where the cleaning blade is in contact with the intermediate transfer belt on the locus r1. In the configuration of FIG. 9, the direction of the reaction force Fr1 is toward the inside of the locus r3, that is, toward the direction in which the blade is compressed in the free length direction. Therefore, in the configuration of FIG. 9, unnecessary force is applied to the blade, which may cause the leading edge of the cleaning blade and the member to be cleaned to be rubbed together to be damaged or may bend the blade.

It is effective that the position of the leading edge of the cleaning blade at the standby position of the cleaning blade is located on the straight line L or away from the image bearing member with respect to the straight line L so that unnecessary force is not applied to the blade in mounting the cleaner unit.

Although an operation of mounting the cleaner unit 60 is described above, an operation of demounting the cleaner unit 60 can be performed in a reversal manner.

As described above, in the present exemplary embodiment, the rotation center of the cleaner unit 60 is used as a lower fulcrum to eliminate a risk that the inside of the main body of the image forming apparatus is dirtied by toner which falls from the opening 66 of the cleaner unit 60 in mounting and demounting the cleaner unit 60. Further, the leading edge 62*a* of the cleaning blade is not subjected to unnecessary stress caused by reaction force in mounting and demounting the cleaner unit 60. Therefore, the present exemplary embodiment can prevent the leading edge 62*a* of the cleaning blade or the surface of the intermediate transfer belt 8 from being damaged to perform a good image formation operation.

The above exemplary embodiment describes the member to be cleaned as the intermediate transfer belt. If a photosensitive drum is set as a member to be cleaned, the same effect can be achieved.

Figure 11:
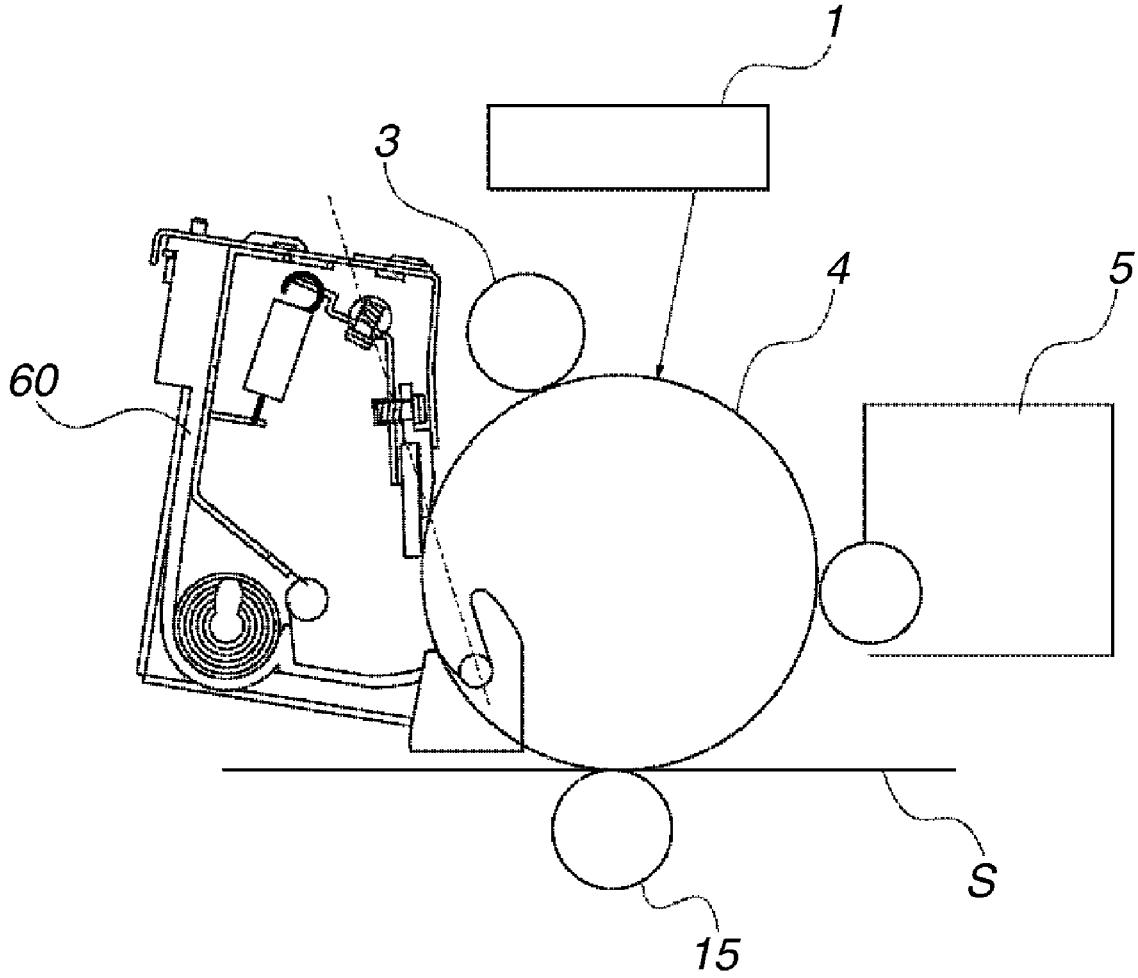
FIG. 11 is a cross section in a second exemplary embodiment.
Figure 12:
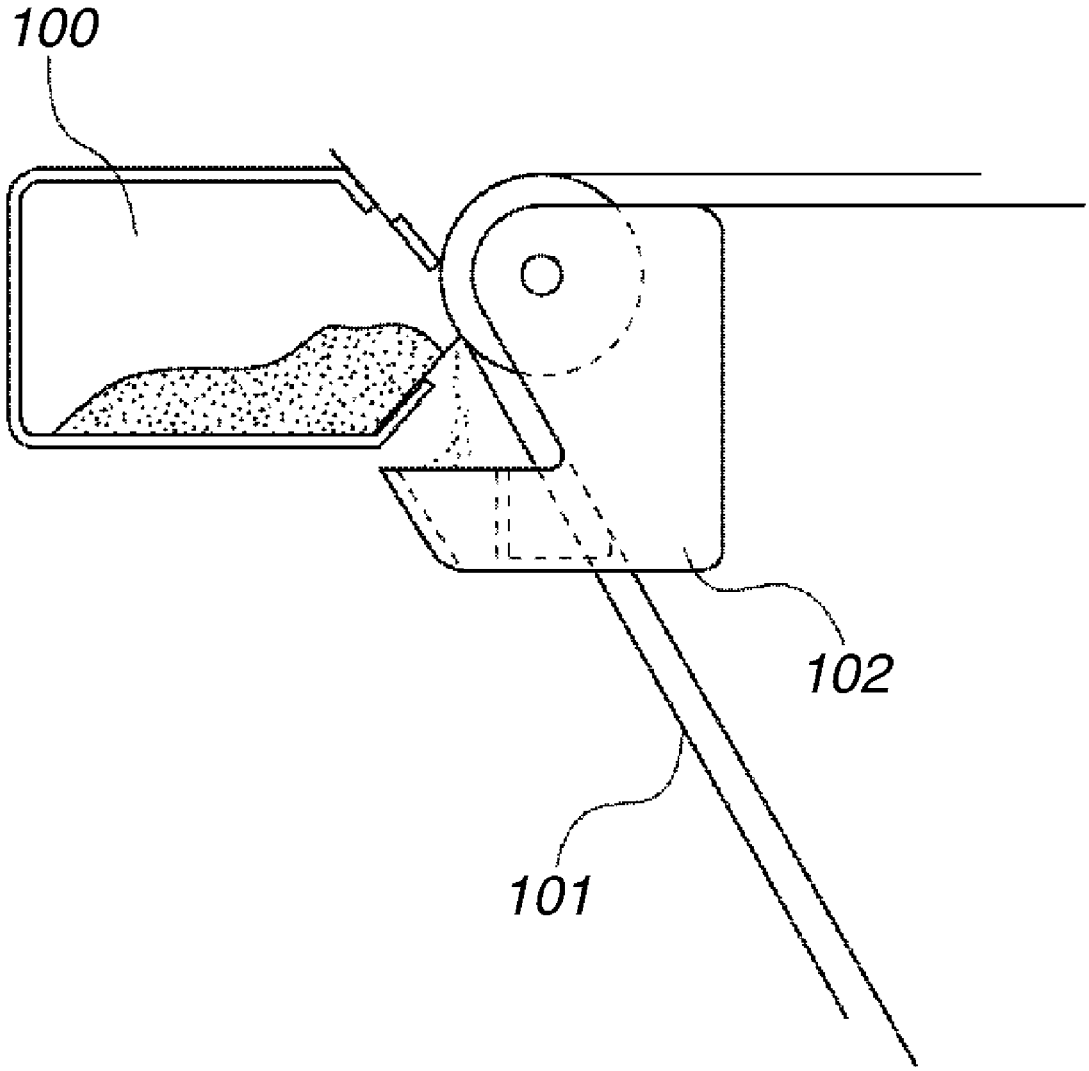
FIG. 12 illustrates a first conventional example.
Figure 13:
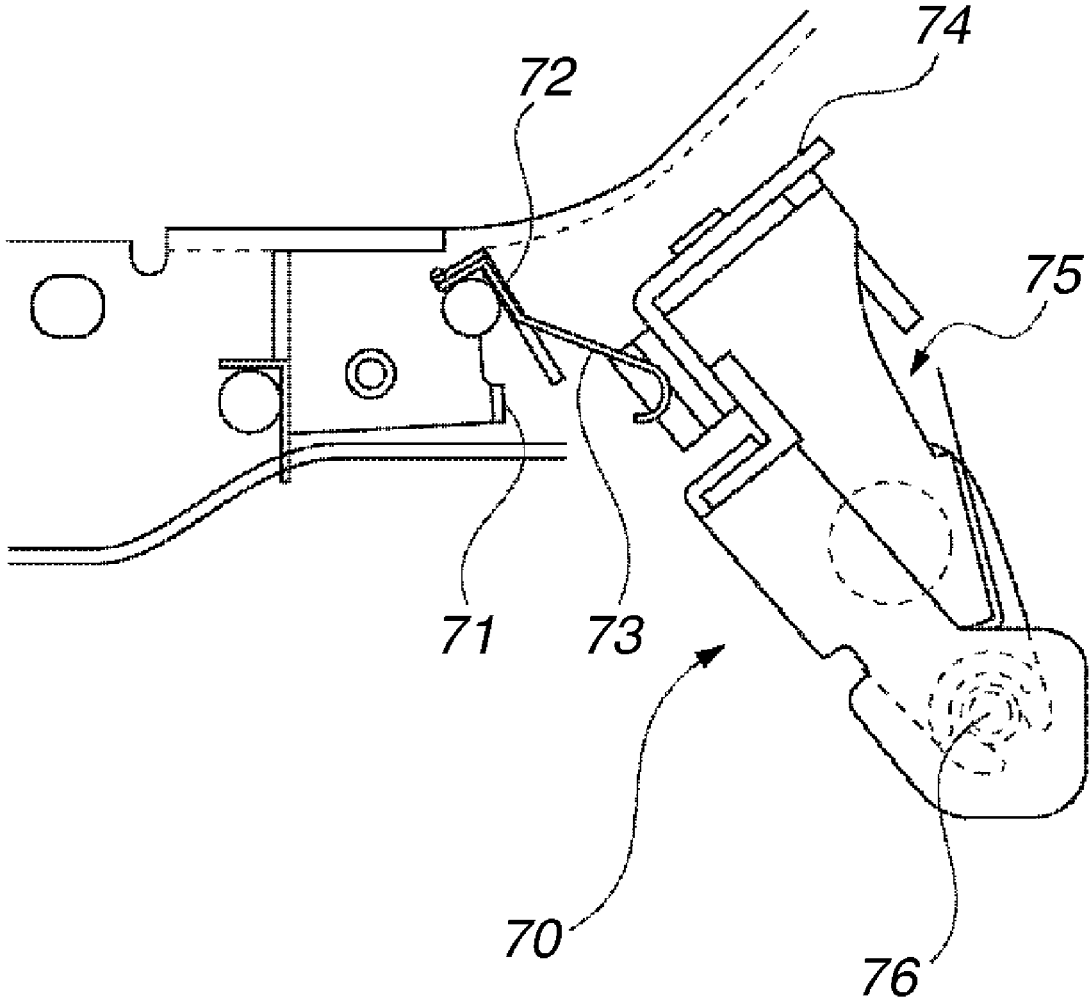
FIG. 13 illustrates a second conventional example.
Figure 14:
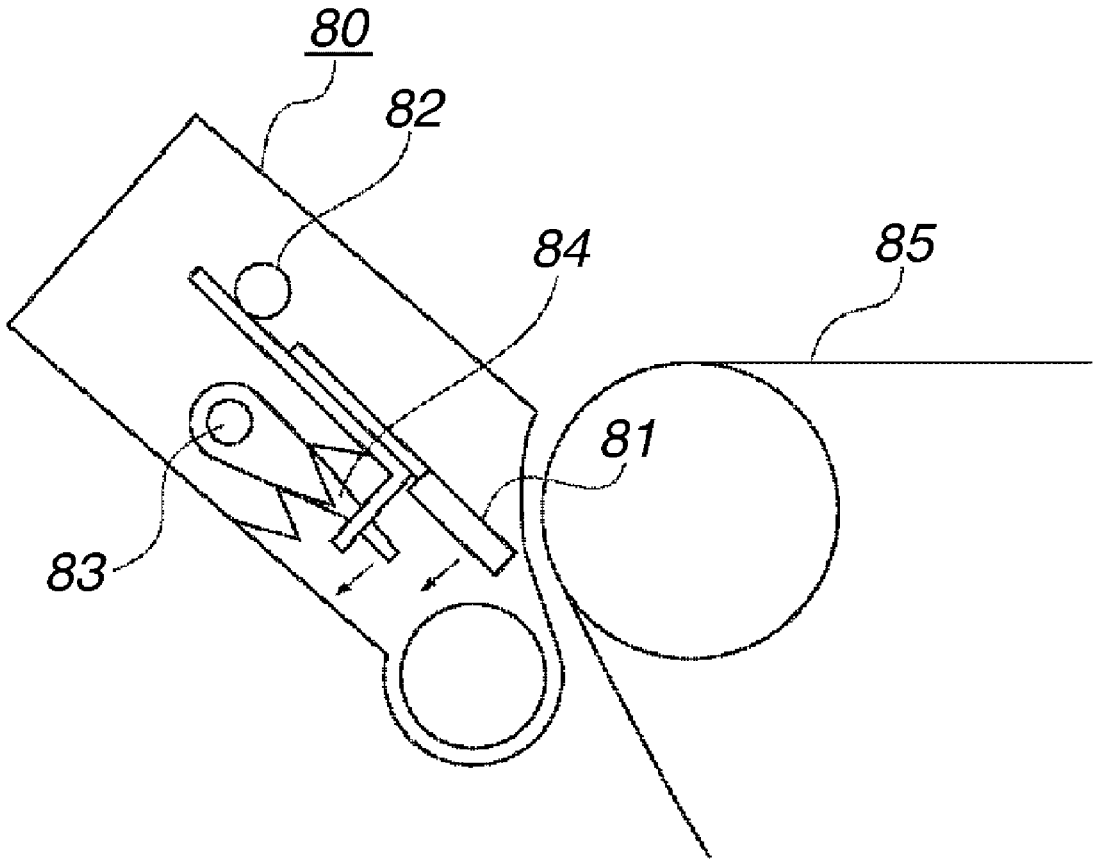
FIG. 14 illustrates a third conventional example.

FIG. 11 illustrates a configuration in which the member to be cleaned is a photosensitive drum as a second exemplary embodiment. In FIG. 11, a photosensitive drum 4 is an image bearing member and charged by a charging roller 3 being a charging device. An exposure apparatus 1 exposes the charged photosensitive drum 4 to light to form an electrostatic image. A development device 5 develops the electrostatic image to form a toner image.

The formed toner image is transferred onto the transfer material S conveyed by the transfer roller 15 being a transfer device. The toner which is not transferred and remained on a surface of the photosensitive drum 4 is collected by the cleaner unit 60. In the present exemplary embodiment, the cleaner unit according to the first exemplary embodiment is used as the cleaner unit 60.

As described above, according to the exemplary embodiments of the present invention, unnecessary force can be prevented from being applied to the cleaning blade when the cleaning blade contacts a member to be cleaned.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2008-233166 filed Sep. 11, 2008, which is hereby incorporated by reference herein in its entirety.

What is claimed is:

1. A cleaning apparatus which cleans toner on an image bearing member, the cleaning apparatus comprising:

a cleaning blade configured to collect toner on a surface of the image bearing member by contacting an edge portion thereof with the image bearing member;

a container configured to store the collected toner therein;

a first rotation axis configured to rotatably support the cleaning blade;

an urging member configured to urge the cleaning blade;

a positioning portion configured to position the cleaning blade so that the cleaning blade urged by the urging member stands by at a predetermined position when the cleaning blade is not in contact with the image bearing member; and a second rotation axis configured to rotatably support the cleaning apparatus while contacting a part of a main body when the cleaning apparatus is mounted on the main body;

wherein the edge portion is positioned on a straight line or away from the image bearing member with respect to the straight line which connects a rotation center of the first rotation axis with a rotation center of the second rotation axis when the cleaning blade is located at the predetermined position.

2. The cleaning apparatus according to claim 1, wherein the positioning portion performs positioning by causing the cleaning blade urged by the urging member to contact the image bearing member.

3. The cleaning apparatus according to claim 1, further comprising:

a guiding unit configured to guide the cleaning apparatus to be mounted so that an opening of the container on which the cleaning blade is arranged is oriented upward when the cleaning apparatus is mounted on the main body.

4. The cleaning apparatus according to claim 1, further comprising:

a stationary unit configured to engaged with an engaging unit on the main body to fix the cleaning apparatus to a cleaning position when the cleaning apparatus is mounted.

* * * * *